US005887404A

United States Patent [19]

Kreizinger

[11] Patent Number: 5,887,404

[45] **Date of Patent: *Mar. 30, 1999**

[54] PRECAST CONCRETE WALL PANEL

[75] Inventor: Kenneth R. Kreizinger, Fort Lauderdale, Fla.

[73] Assignee: Kreico Building Systems, Inc., Pampano Beach, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 630,014

[22] Filed: Apr. 9, 1996

[51] Int. Cl.[6] ..... E04B 2/46

[52] U.S. Cl. ..... 52/592.1; 52/436; 52/592.4; 52/742.14; 52/745.1; 256/19

[58] Field of Search ..... 52/250, 259, 592.4, 52/592.1, 742.14, 742.95, 436, 583.1, 439, 745.1; 256/13.1, 19, 24

[56] References Cited

U.S. PATENT DOCUMENTS

| | | | |
|---|---|---|---|
| 3,342,033 | 9/1967 | Crouch et al. | 256/19 X |
| 3,422,588 | 1/1969 | Stewart, Jr. | 52/436 |
| 3,507,084 | 4/1970 | Joy et al. . | |
| 3,535,838 | 10/1970 | Hoff . | |
| 3,678,638 | 7/1972 | Mouglan . | |
| 3,683,577 | 8/1972 | Spillman . | |
| 3,694,531 | 9/1972 | Glass . | |
| 4,019,293 | 4/1977 | Armas . | |
| 4,393,636 | 7/1983 | Rockstead et al. . | |
| 4,398,378 | 8/1983 | Heitzman . | |
| 4,616,459 | 10/1986 | Shubow . | |
| 4,787,189 | 11/1988 | Haug et al. . | |
| 4,998,393 | 3/1991 | Baema . | |
| 5,218,797 | 6/1993 | Kruse . | |
| 5,327,699 | 7/1994 | Khan et al. . | |
| 5,344,700 | 9/1994 | McGath et al. . | |
| 5,361,556 | 11/1994 | Menchetti . | |
| 5,400,563 | 3/1995 | House et al. | 256/19 X |
| 5,404,685 | 4/1995 | Collins | 52/309.7 |
| 5,471,811 | 12/1995 | House et al. | 256/13.1 X |
| 5,524,405 | 6/1996 | Byrd | 256/19 X |
| 5,649,689 | 7/1997 | Wilson | 256/19 X |
| 5,689,927 | 11/1997 | Knight, Sr. | 52/297 |

*Primary Examiner*—Christopher Kent
*Assistant Examiner*—Timothy B. Kang
*Attorney, Agent, or Firm*—White & Case L.L.P.

[57] ABSTRACT

A wall system comprising a plurality of wall panels. Each panel has a vertically extending pilaster formed integrally with one end, defining a vertically open hollow core area of sufficient size for forming a concrete cast-in-situ column for supporting the panel in an upright position. The pilaster further includes an outwardly open groove communicating with the hollow core area. Each panel also has an integrally cast tongue projecting from its other said end, which is received in the groove of an adjoining panel to enclose the hollow core area. A concrete column is cast-in-situ in the hollow core area. Preferably, the pilaster is positioned on a concrete foundation or footing, which includes reinforcement members that project up into the hollow core area such that, when the column is cast, the reinforcement members are embedded in the concrete column. Adjoining panels may be positioned in end-to-end relation, at an angle relative to one another, or stacked.

15 Claims, 5 Drawing Sheets

PRECAST CONCRETE WALL PANEL

FIELD OF THE INVENTION

The present invention relates to building wall systems of the type formed of multiple precast wall panels.

BACKGROUND OF THE INVENTION

The use of precast building panels in construction is well known. Both lower costs and a higher quality product can be achieved in a precast factory setting. However, existing precast wall systems, whether made of hollow core or solid panels, are typically flat in that both faces are cast in the same respective plane. While a flat surface is a desirable feature in many applications, there are applications where flat surfaces are not necessary, and other applications where protrusions are actually more desirable and architecturally pleasing.

When a precast panel is combined with a cast-in-situ column, the outer surfaces of the panels must be wide enough to facilitate an adequately sized column. This requires either a relatively thick solid panel, or the fabrication of a hollow core panel, both of which can be costly.

The seams between two precast panels present another problem. Typically, the seam requires additional finishing work or otherwise must be covered in some fashion.

In applications where the precast panels are used as privacy or security walls, they typically require a separate post into which the panel is slipped or otherwise attached. This requires fabrication, handling and installing of two pieces, which is undesirable.

In some precast panels, there is an interlocking design. The purpose of the design, however, is solely to lock the panels. The panels must be separately connected to the foundation or building.

A further shortcoming of known precast panel systems is the inability to either facilitate or conceal expansion joint material that may be necessary for a particular application. Such material is unsightly or at least difficult and expensive to cover and conceal.

SUMMARY OF THE INVENTION

The present invention provides a novel method of connecting and securing precast wall panels to each other and to a foundation. These solid panels have a hollow core pilaster area at one end and a tongue at the other end. The panel's hollow core pilaster is manufactured with an outwardly open groove into which the adjoining panels's tongue is slipped during installation. Once inserted into the pilaster's groove opening, the adjoining panel's tongue acts to totally enclose the hollow core area to enable cast-in-situ concrete to be placed inside, thereby creating a structural column and connecting the two panels together. The hollow core pilaster may be dimensioned so that a reinforced cast-in-situ column has sufficient thickness to provide the required structural strength for the particular application.

In the preferred embodiment of the invention, the precast wall panel's body is solid and relatively thin. The top section of each precast panel has an integrally cast reinforced beam, of whatever size is needed for a particular structural design. For example, the panel wall may be four inches thick while the beam may be eight inches thick. A typical panel may be ten feet high and 20 feet long. The pilaster area is substantially wider than the panel wall to enable it to contain a typical 8 inch×12 inch cast-in-situ column, which is further strengthened by the two-to-three inches of precast concrete forming the pilaster's perimeter.

Although the invention is principally directed to a multi-panel wall system, in an alternate embodiment a wall panel according to the invention is precast with a hollow core pilaster area that is totally enclosed. Such panel can be positioned on a foundation and a column cast in situ in the hollow core area of the pilaster, in a manner similar to the multi-panel system. For added strength, and particularly for applications where one end of the panel cannot be anchored to an existing structure, a hollow pilaster is provided at either end of the panel wall.

The invention provides considerable flexibility in designing panels to meet varying requirements of structural strength. For example, the panel's precast beam and cast-in-situ column may be of various sizes to withstand weight or stresses for a particular application. In addition, the beam steel reinforcement may protrude into the pilaster column's hollow core area to provide a greater structural connection as may be desired. Also, the panel body's steel reinforcement may also protrude from its tongue in order to provide a greater connection to the adjoining panel's cast-in-situ column.

The invention provides for a method of connecting stacked panels, i.e., panels used in multi-story constructions, by extending the cast-in-situ column from a lower panel into an upper panel. When multi-story panels are erected, the hollow core column areas are aligned directly above one another to facilitate a continuous cast-in-situ column for several stacked panels. In addition, the reinforcement steel can extend from the lower panel into the upper panels to create a reinforced concrete structural column.

In panels intended for multi-story construction, the integrally cast beam preferably contains a groove in its upper surface, and the bottom surface of the panel correspondingly has a downwardly extending tongue running along its length that fits into the groove. This top groove, which may be relatively shallow, e.g., less than one inch deep, facilitates both faster positioning of the upper panels as well as providing a better joint when used in conjunction with caulk or other type of sealant.

The wall panels may be manufactured, handled, and transported either vertically or horizontally. To create the hollow core area for the cast-in-situ column, either a collapsible or a tapered form may be used.

A panel according to the invention may be used with either continuous or intermittent foundations. An intermittent foundation may consist of individual concrete footings, located under each panels' pilaster, onto which the column is cast-in-situ. Dowel bars or other reinforcing connection apparatus may extend from the foundation into the hollow core area of the piaster column. The panels are set on the foundation and braced as needed. The adjoining panel is then positioned such that its tongue slides into the pilaster's groove opening in the first panel.

A structural design of the panels according to the present invention make them inherently simple, fast, and easy to install. For example, when a panel is placed on a pair of footings or other foundation, the oversized pilaster helps keep the panel temporarily upright. When additional panels are positioned, the fact that the tongue end of each panel is inserted in the groove of an adjoining panel's pilaster further helps stabilize the multiple panel array until the columns are poured.

The panel according to the invention provides a simple means of allowing for expansion and contraction between said adjoining panels. Prior to sliding a panel's tongue into the adjoining panel's grooved opening, expansion material may be attached to the end of the tongue and thereby positioned between the first panel's cast-in-situ column and the second panel's body. Once in place, the expansion material is completely concealed from view inside of the pilaster.

The panel according to the invention provides a simple and attractive method by which to minimize the visual effects of the seam. With the seam hidden on the inside of the panel's pilaster, it is far less noticeable, and in some cases totally unnoticeable, from the front. This eliminates the need for costly finishing or other steps needed to cover the seam.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 1:
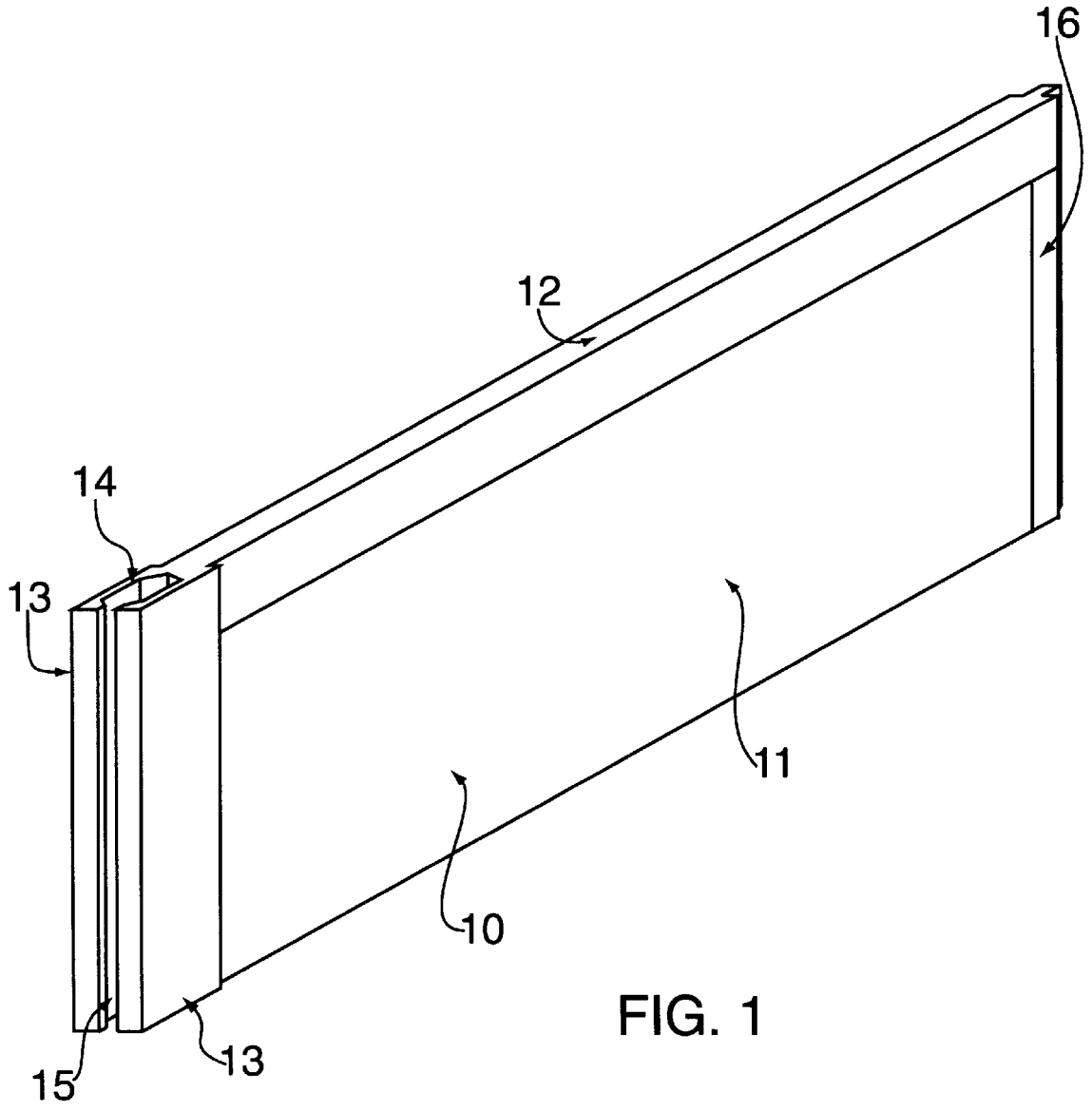
FIG. 1 is a perspective view of an example of a wall panel for use in a wall system according to the invention.

A first embodiment of a precast, concrete wall panel 10 is shown in FIG. 1. The panel 10 has a solid wall 11 with an integrally cast, horizontal beam 12 that is located above the wall 11 and that extends axially along the top of the wall 11. The panel 10 also has an integrally cast, vertically extending pilaster 13 at one end. The pilaster 13 contains an outwardly open groove 15 that faces away from the wall 11 and that communicates with a vertically extending hollow core area 14 having a width (in a direction perpendicular to the wall 11) greater than the groove 15. The other end of the panel 10 contains an axially protruding tongue 16 that is sized to fit in the groove 15 and protrude partially into the hollow core area 14.

Figure 2:
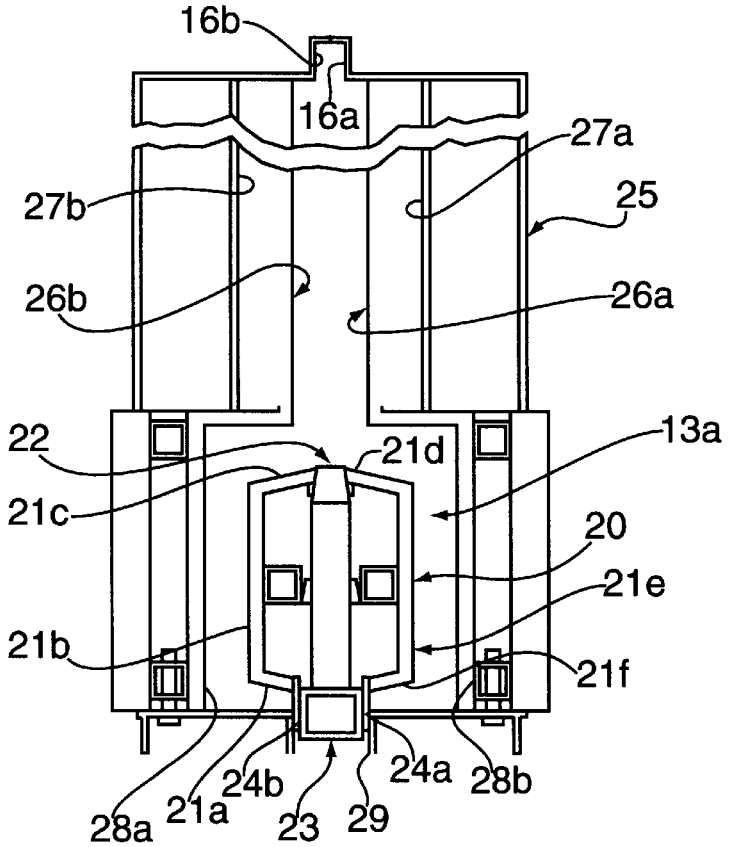
FIG. 2 is a top view of an example of formwork for casting the wall panel of FIG. 1.
Figure 3:
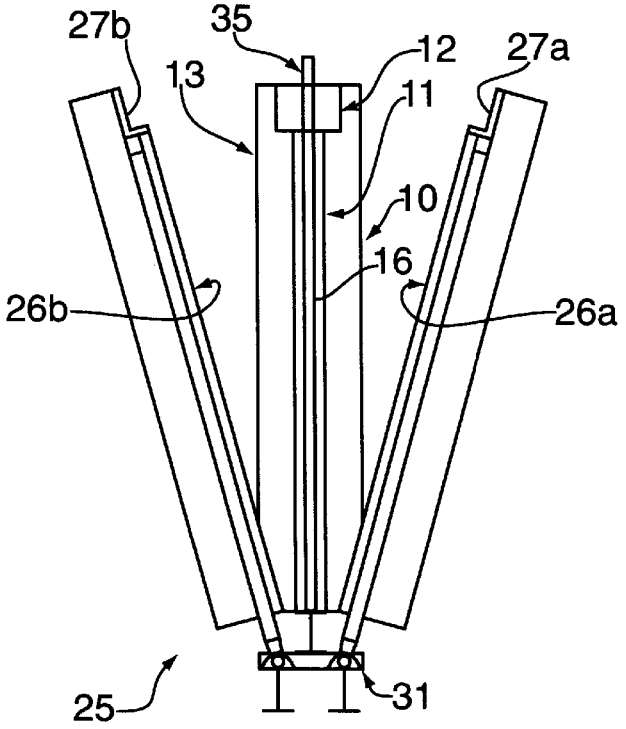
FIG. 3 is a front view of the formwork, after casting a wall panel.

Referring to FIGS. 2–3, a concrete wall panel 10 may be cast using an external formwork 25 in conjunction with an internal formwork 20. External formwork 25 includes a pair of opposed walls 26*a*, 26*b* that define a space for casting the main wall 11, a pair of opposed walls 27*a*, 27*b* that define a space for casting the horizontal beam 12, and opposed end forms 28*a*, 28*b* that define a rectangular, box-like space 13*a* for casting the pilaster 13. The end forms 28*a*, 28*b* also define a vertically extending groove 29 at one end, and a pair of projecting sections 16*a*, 16*b* at the opposite end that define an open area for forming the tongue 16.

The internal formwork 20 is disposed in the space 13*a* used to create the pilaster 13, preferably centered in the space 13*a*. The internal formwork 20 includes faces 21*a*–21*c* and 21*d*–21*f*, that are attached with a hinge 22, and that define the inner surface for the hollow core area 14. The formwork 20 also includes a pair of flanges 24*a*, 24*b* that are disposed in the external formwork groove 29 and that define the opposite sides of the panel groove 15. The flanges 24*a*, 24*b* are spaced apart by a spacer 23. Alternatively, the grooved area may be created with a spacer, similar to spacer 23, alone.

To form the panel 10, concrete is poured into the spaces defined by the exterior and interior formwork 25, 20, either with or without reinforcing. Once the concrete has sufficiently set, the spacer 23 is removed, allowing the two halves, 21*a*–21*c* and 21*d*–21*f*, respectively, of the internal formwork 20 to be pivoted toward one another and removed from the hollow core area 14. The two halves of the exterior formwork 25, which as shown in FIG. 3 are pivotably secured to one another on a hinge mechanism 31, can then be pivoted open to remove the panel 10. Preferably, a plurality of lifting inserts 35 are positioned in the top of the panel prior to casting. The inserts 35 may be used for handling the panel and are removed after the panel has cured.

Figure 4:
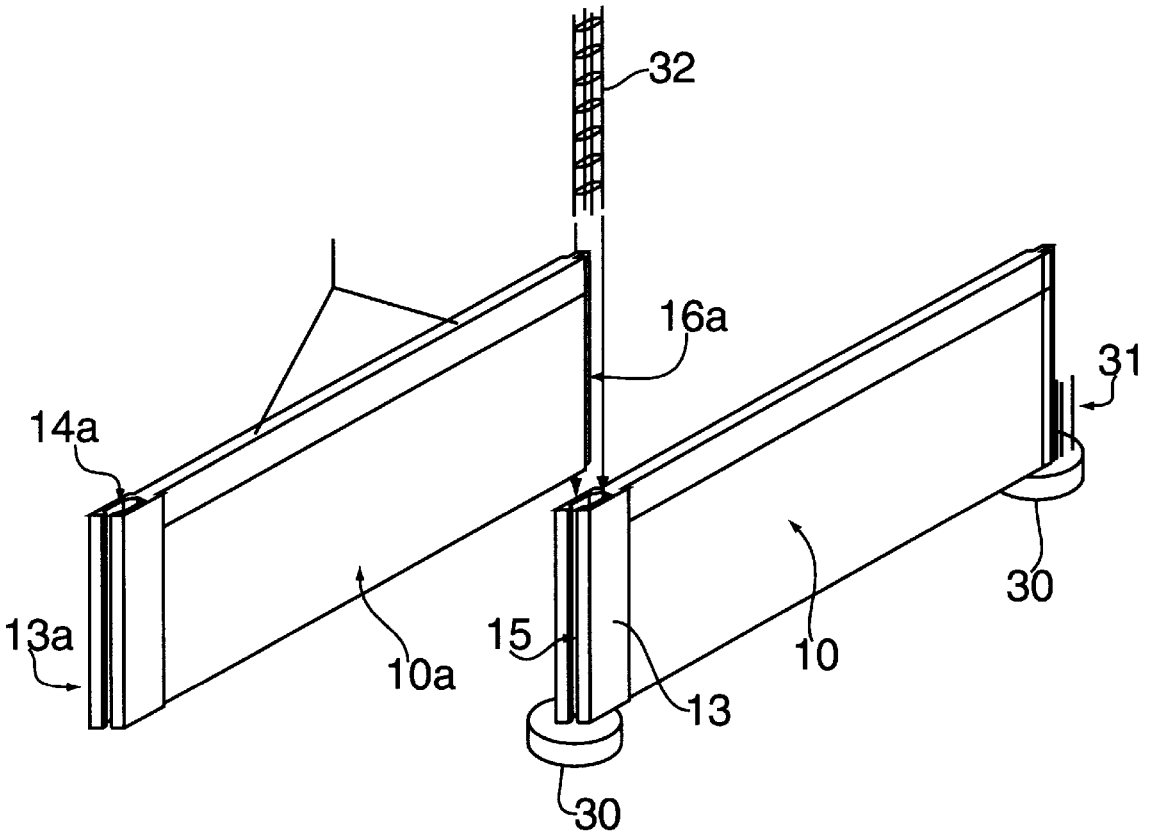
FIG. 4 is a perspective view of two wall panels, during assembly.

A wall system according to the invention is preferably formed of a plurality of panels 10. In the example of FIG. 4, the ends of the panels are supported on individual concrete footings 30, which are well known and easy to pour in the ground. The wall panels, however, can be mounted on any type of foundation.

The concrete footings 30 preferably have a plurality of partially embedded reinforcement bars 31, whose free ends extend upwardly. A first panel 10 is lowered so that its opposite ends are supported on a pair of footings 30 and temporarily stabilized. In the position shown, the reinforcement bars 31 of the footing 30 associated with the pilaster 13 extend up into the hollow core area 14 of panel 10. A second concrete panel 10*a* is then positioned so that it tongue 16*a* extends in the groove 15 of the first panel 10. A reinforcement cage 32 is preferably then slid down into the hollow column area 14 and over the dowl bars 31.

Figure 5:
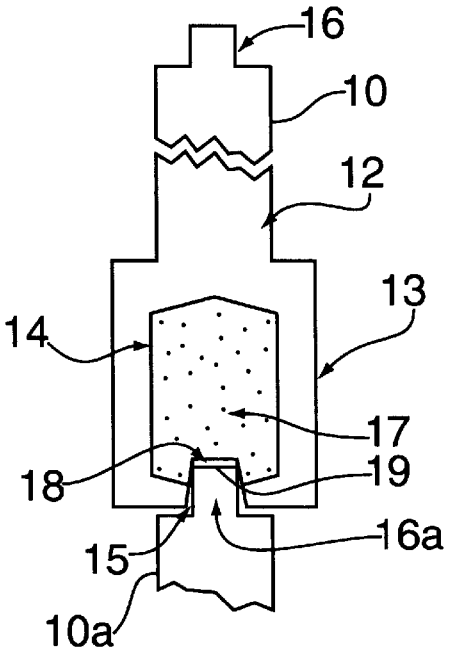
FIG. 5 is a top view of a pair of wall panels forming a wall system according to the invention.

As shown in FIG. 5, the panels 10*a*, 10 are aligned axially, and the tongue 16*a* of one panel 10*a* has been inserted into the groove 15 of the adjoining panel 10. When the tongue 16*a* is inserted into the groove 15, the forward face 19 of the tongue 16*a* acts together with the pilaster 15 of panel 10 to enclose a columnar space. The enclosed space, in which the reinforcement cage 32 has been positioned, is cast-in-situ with concrete, to form a support column 17 for the wall system. Preferably, prior to casting, a layer of expansion material 18 is disposed between the forward face 19 of the tongue 16*a* and the concrete column 17.

Figure 6:
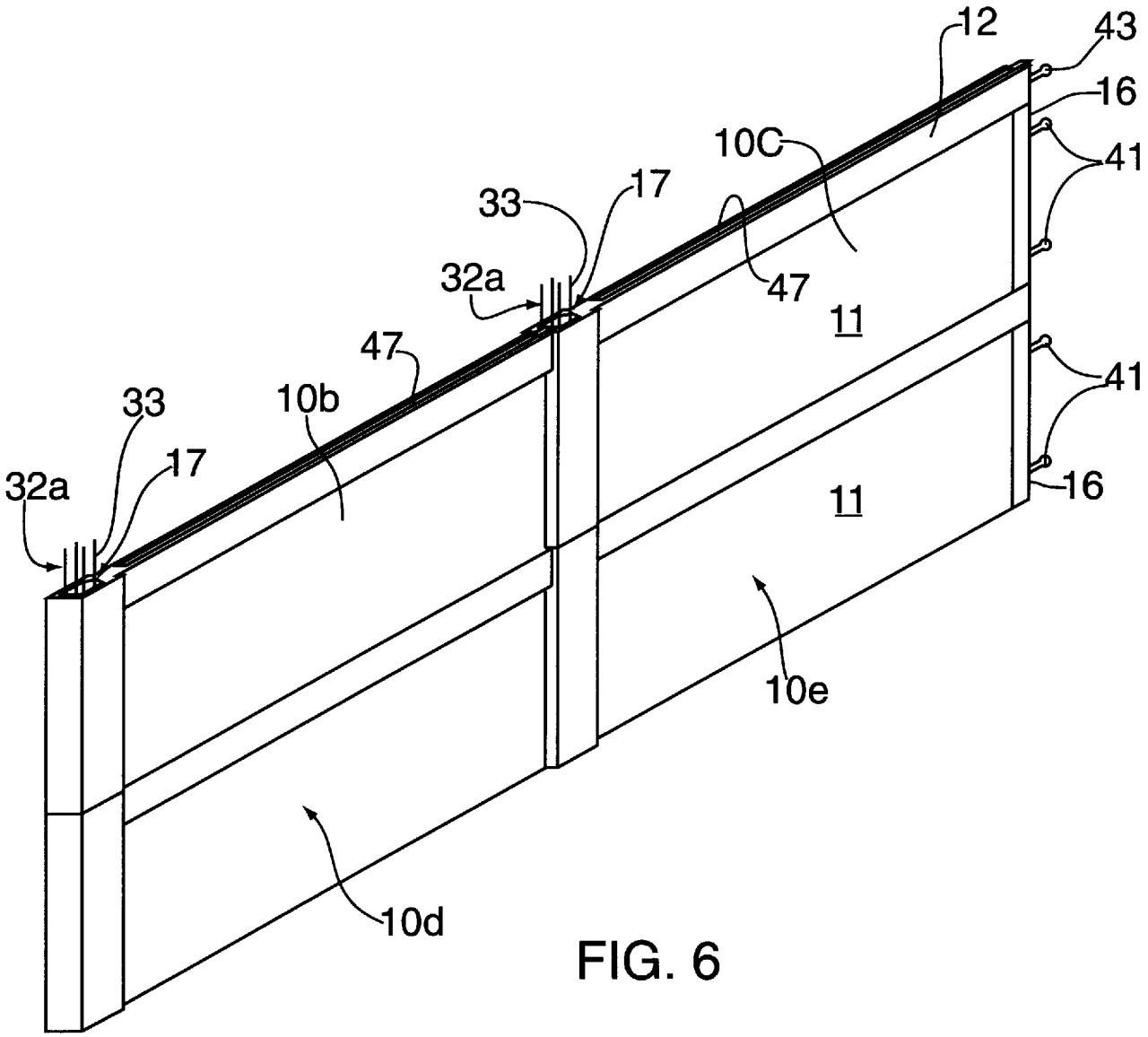
FIG. 6 is a perspective view of another embodiment of a wall system, containing stacked wall panels.

FIG. 6 shows an embodiment of a multi-story wall system, in which four panels, 10*b*–10*e*, are stacked to two levels and are ready to receive a third level. As shown, the reinforcing cages 32*a* for upper panels 10*b*, 10*c* include reinforcement bars 33 that project above the columns 17 in order to anchor the next level. When the next level of panels 10 are set, the bars 33 will extend up into the hollow core area 14 of the next panel, and will be embedded in the column 17 of the next panel when the column 17 is cast. Similarly, panels 10*d* and 10*e* use similar reinforcement cages 32*a*, such that the reinforcement bars 33 of the panels 10*d* and 10*e* extend up into, and are embedded in, the columns 17 of the panels 10*b*, 10*c* above them.

The panels used in FIG. 6 also contain a groove 47 running along the upper surface of the beam 12. The corresponding lower surface of the panel wall 11 is provided with an interfitting tongue, which facilitates stacking of panels in a multi-story configuration.

As also shown in FIG. 6, if desired a portion of the reinforcement, designated 41, used in the panel walls 11, can project outwardly from the tongue 16. Similarly, reinforcement used in the beam 12, as shown by 43, can project from the tongue 16. In either case, when the tongue 16 is inserted in the groove 15 of the next panel, the reinforcement 41 or 43 will project into the hollow concave area 14, and will be embedded in the cast-in-situ column 17.

Figure 7:
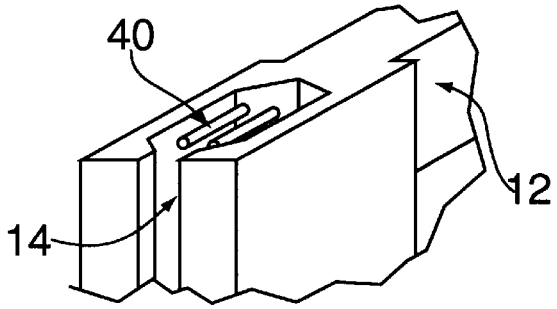
FIG. 7 is a perspective view of an end section of another embodiment of wall panel.

FIG. 7 shows an alternative embodiment of a panel 42 in which steel connecting beams 40 project horizontally from the precast top beam 12 into the open column area 14. When the column 17 is subsequently cast-in-situ in the open column area 14, the steel connecting beams help anchor the column 17 to the beam 12, to increase the structural support.

Figure 8:
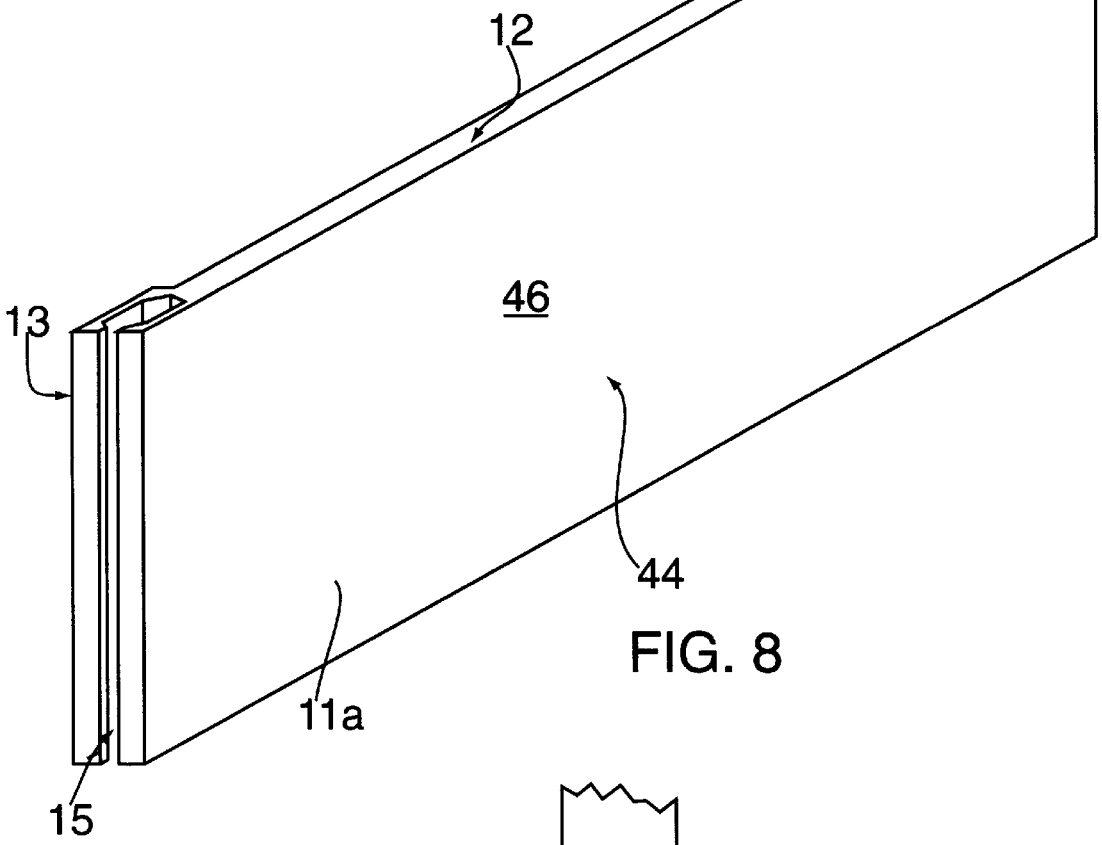
FIG. 8 is a perspective view of another embodiment of a wall panel.

FIG. 8 shows an alternative embodiment of a wall panel 44. In this embodiment, the front walls of the main panel 11*a*, top beam 12, and pilaster 13 are flush so as to create a flat facing wall 46. To create the flat facing wall 46, the beam 12, pilaster 13, and tongue 16 are offset rearwardly as shown, i.e., are not centered relative to the main panel 11*a*.

Figure 9:
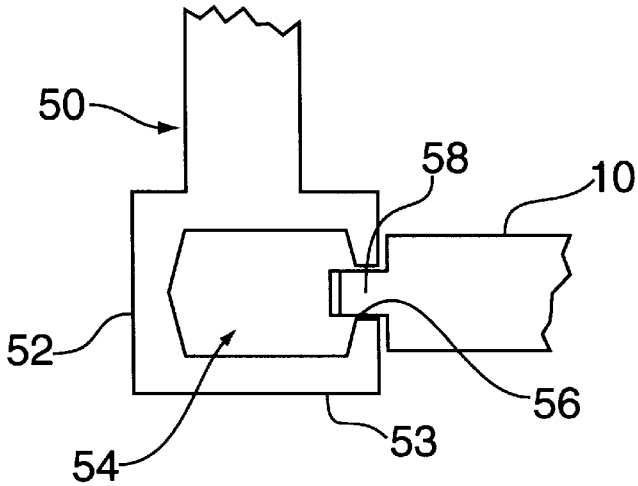
FIG. 9 is a top view of a pair of wall panels forming a comer according to the invention.

In FIG. 9, one panel 50 has a pilaster 52, defining an open column area 54 and an outwardly open groove 56. The panel 50 is the same as the panel 10 of FIG. 1, except that the pilaster is rotated 90 degrees, such that when the tongue 58 of a second panel 10 is received in the groove 56, the two panels 10, 50 are perpendicular to one another. The panel 50 can be used to form corners. Alternately, the pilaster 53 can be oriented at angles other than 90 degrees, for example when the wall system is intended to follow generally a curve.

The precast panel according to the invention provides for a fast and cost efficient way for building simple walls where a flat surface on both wall faces is unnecessary or undesirable. The tongue and groove connection provides for a quick and easy way to set, align, and temporarily secure the panels. The hollow core pilaster area eliminates the need for all field formwork while providing a means for casting structural columns that permanently attach the panels to each other and to the foundation.

The foregoing represents preferred embodiments of the invention. Variations and modifications will be apparent to persons skilled in the art, without departing from the inventive principles disclosed herein. For example, the beam area may be precast with devices that facilitate floor and roof connections. In addition, double pilaster and double tongued panels may be used in this system. Or the pilaster and the beam may be offset to one side thereby creating a flat wall surface on one side and protruding pilaster and beam on the other side. In addition, although rectangular pilasters are disclosed in connection with the exemplary embodiments, other shapes, either for structural or aesthetic purposes, may be employed. All such modifications and variations are intended to be within the scope of the invention, as defined in the following claims.

I claim:

1. A precast concrete wall panel comprising:

a panel wall having first and second opposite ends, a front, a back, and a thickness, measured in a front-to-back direction; and a vertically extending pilaster having a front wall, a back wall, and opposed side walls, wherein one side wall of said pilaster is formed integrally with said first end of said panel wall, wherein said pilaster walls define a hollow core extending vertically through said pilaster, wherein said core has a depth, in a front-to-back direction, and a width, in a side-to-side direction, which is substantially greater than the thickness of said panel wall so as to be of sufficient size for forming a concrete cast-in-situ column for supporting said panel in an upright position, wherein said pilaster includes an outwardly open groove communicating with said hollow core and being at least substantially coextensive therewith, wherein the width of said groove is substantially the same as the thickness of the second end of said panel wall such that the second end of a second panel may be inserted into said groove to enclose, on four sides, said hollow core.

2. A precast concrete wall panel according to claim 1, wherein the second end of said panel wall comprises an integrally cast, projecting tongue having a cross-sectional thickness, measured in a front-to-back direction, which is less than the thickness of said panel wall, wherein said groove has a width which is substantially the same as the tongue thickness, and wherein the tongue has a length such that, when inserted through the groove of another such panel it defines, with said pilaster walls, on four sides, an enclosed hollow core.

3. A precast concrete wall panel according to claim 2, wherein said outwardly open groove faces away from said panel wall.

4. A precast concrete wall panel according to claim 3, wherein said panel further includes a horizontal beam cast integrally with said wall panel, tongue, and pilaster.

5. A precast concrete wall panel according to claim 2, wherein said outwardly open groove faces at an angle relative to said panel wall.

6. A wall system comprising at least a first wall panel and a second wall panel, wherein each panel comprises:

a panel wall having first and second opposite ends, a front, a back, and a thickness, measured in a front-to-back direction;

a vertically extending pilaster having a front wall, a back wall, and opposed side walls, wherein one side wall of said pilaster is formed integrally with said first end of said panel wall, wherein said pilaster walls define a hollow core extending vertically through said plaster, wherein said core has a depth, in a front-to-back direction, and width, in a side-to-side direction, which is substantially greater than the thickness of said panel wall so as to be of sufficient size for forming a concrete cast-in-situ column for supporting said panel in an upright position, and wherein said pilaster further includes an outwardly open groove communicating with said hollow core and being at least substantially coextensive therewith, wherein the width of said groove is substantially the same as the thickness of the second end of said panel wall;

wherein the second end of said first panel is disposed in the groove of said second panel to enclose, together with the pilaster of the second panel, on four sides, the hollow core of the second panel; and wherein said wall system further comprises a concrete column cast-in-situ in the hollow core of said second panel.

7. A precast concrete wall panel according to claim 6, wherein the second end of each said panel wall comprises an integrally cast, projecting tongue having a cross-sectional thickness, measured in a front-to-back direction, which is less than the thickness of said panel wall, wherein said groove has a width which is substantially the same as the tongue thickness, and wherein said tongue extends through said groove to define, with said pilaster walls, said enclosed hollow core.

8. A wall system according to claim 7, wherein each said panel further includes a horizontal beam cast integrally with said wall panel, tongue, and pilaster.

9. A wall system according to claim 8, wherein said beam includes a reinforcing member projecting from said first end into said hollow core and being embedded in said column.

10. A wall system according to claim 8, wherein said beam includes a reinforcing member projecting from said second end, through said tongue, into said hollow core area and being embedded said column.

11. A wall system according to claim 8, wherein said panel wall includes a reinforcing member projecting from said second end, through said tongue, into said hollow core area and being embedded said column.

12. A wall system according to claim 8, comprising a least at third panel which is positioned on said first panel, and which has a hollow core disposed above, and communicating with, the hollow core of said first panel, and wherein a single column extends upwardly through the hollow core of said first and third panels.

13. A wall system according to claim 12, wherein the beam of said first panel includes an upper surface having a guide groove, and wherein the panel wall of said third panel has a lower surface with a downwardly extending projection sized to fit into said guide groove to facilitate stacking of said panels.

14. A method of forming a wall, comprising the steps of:

forming a first panel with a panel wall with first and second opposite ends, a front, a back, and a thickness, measured in a front-to-back direction; a vertically extending pilaster having a front wall, a back wall, and opposed side walls, wherein one side of said pilaster is formed integrally with said first end of said panel wall, wherein said pilaster walls define a hollow core extending vertically through said pilaster, wherein said core has a depth, in a front-to-back direction, and width, in a side-to-side direction, which is substantially greater than the thickness of said panel wall so as to be of sufficient size for forming a concrete cast-in-situ column for supporting said panel in an upright position, and wherein said pilaster further includes an outwardly open groove communicating with said hollow core and being at least substantially coextensive therewith, wherein the width of said groove is substantially the same as the thickness of the second end of said panel wall;

forming a second panel having the said pilaster, hollow core area, and groove;

erecting said second panel so that its pilaster is supported upright on a foundation member;

positioning said first panel so that its second end is disposed in the groove of said second panel to enclose, together with the pilaster walls of the second panel on four sides, the hollow core of said second panel; and pouring concrete in situ into the hollow core of said second panel member to form a column.

15. A method according to claim 14, comprising the steps of forming the second end of each said panel wall with an integrally cast, projecting tongue having a cross-sectional thickness, measured in a front-to-back direction, which is less than the thickness of said panel walls, and forming said groove to have a width which is substantially the same as the tongue thickness, and wherein the step of positioning the first panel comprises the step of inserting said tongue through said groove to enclose, with said pilaster walls, on four side, said enclosed hollow core prior to pouring concrete to form said column.

* * * * *